United States Patent [19]

Chapple

[11] 4,381,171

[45] Apr. 26, 1983

[54] CASTING FOR A TURBINE WHEEL

[75] Inventor: Paul M. Chapple, Columbus, Ind.

[73] Assignee: Cummins Engine Company, Inc., Columbus, Ind.

[21] Appl. No.: 228,163

[22] Filed: Jan. 23, 1981

Related U.S. Application Data

[63] Continuation of Ser. No. 953,101, Oct. 20, 1978, abandoned.

[51] Int. Cl.[3] ..... F01D 1/08; F01D 25/24

[52] U.S. Cl. ..... 415/204; 415/205; 415/157

[58] Field of Search ..... 415/203, 204, 205, 206, 415/207, 219 B, 219 C, 157, 158; 60/600, 602

[56] References Cited

U.S. PATENT DOCUMENTS

| | | | |
|---|---|---|---|
| 1,328,835 | 1/1920 | Kasley | 415/203 |
| 2,280,585 | 4/1942 | Kapitza | 415/205 |
| 2,944,786 | 7/1960 | Angell et al. | 415/205 X |
| 3,557,549 | 1/1971 | Webster | 415/219 C |
| 4,027,994 | 6/1977 | MacInnes | 415/203 |
| 4,143,994 | 3/1979 | Yamaguchi | 415/205 |

FOREIGN PATENT DOCUMENTS

| | | | |
|---|---|---|---|
| 168357 | 11/1950 | Austria | 415/203 |
| 1034192 | 7/1958 | Fed. Rep. of Germany | 415/158 |
| 518913 | 6/1921 | France | 415/204 |

OTHER PUBLICATIONS

Shepherd, D. G., *Principles of Turbomachinery*, New York, MacMillan Co., 1956, p. 284.

*Primary Examiner*—Philip R. Coe
*Assistant Examiner*—Joseph M. Pitko
*Attorney, Agent, or Firm*—Neuman, Williams, Anderson & Olson

[57] ABSTRACT

A housing surrounds a rotatable turbine wheel having an axis of rotation and effects a uniform fluid wheel boarding state. The housing includes at least one elongated substantially spiral passageway which encompasses the periphery of the wheel. The passageway has an external peripheral fluid inlet and an internal fluid outlet, the latter encompassing the wheel periphery. The passageway is defined by a pair of opposed axisymmetrical side walls having an inner diameter proximate the periphery of said turbine wheel. An outer wall extends between the two side walls circumferentially around at least 360° of the turbine axis. The radial location of the outer rail is defined by the path prescribed by the direction of fluid flow in a free vortex constrained by the side walls. Disposed within the passageway and extending substantially throughout same may be a multi-portion generally helical partition. The portions thereof are mounted for selective transverse movement relative to the longitudinal axis of the passageway.

9 Claims, 16 Drawing Figures

FIG. 14
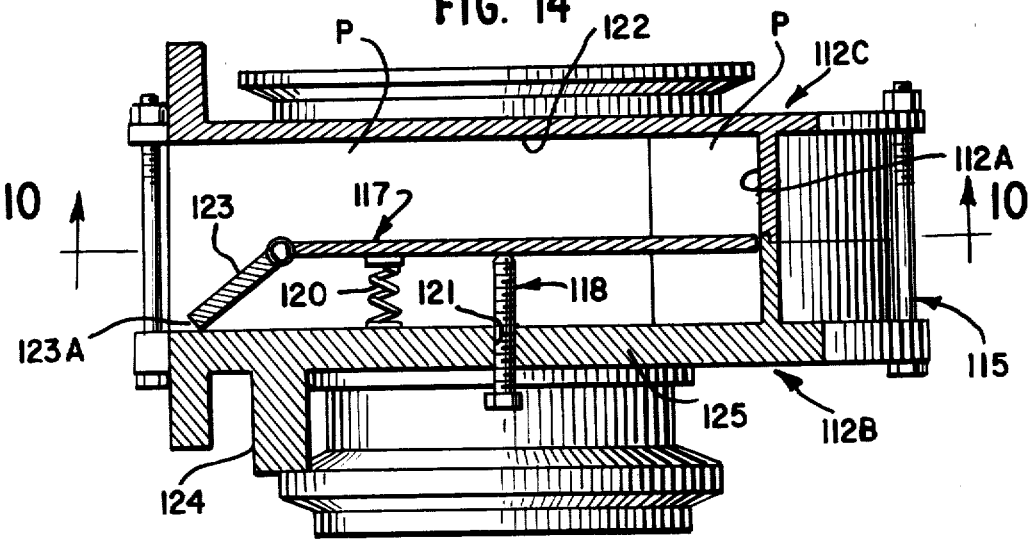
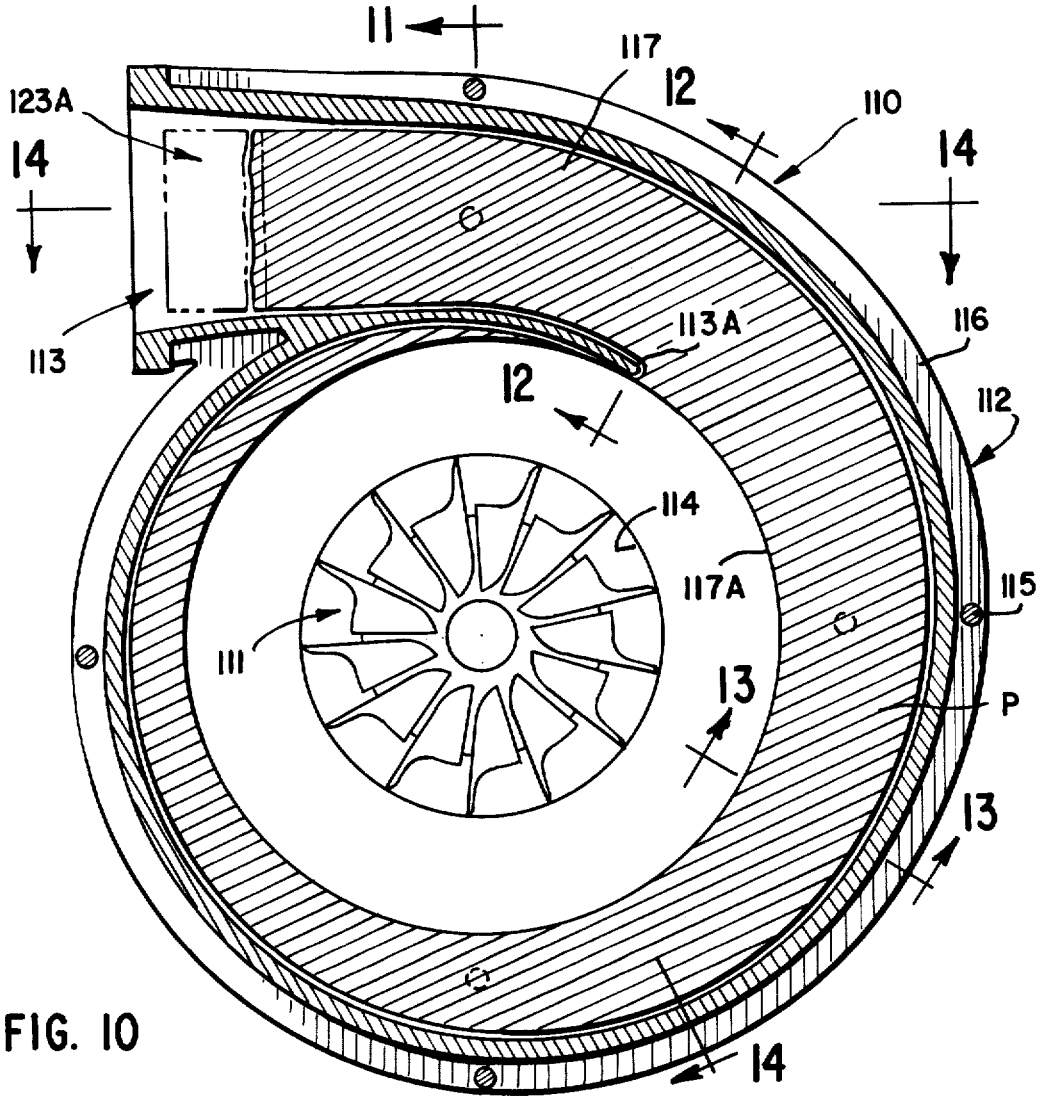
FIG. 10

FIG. 11
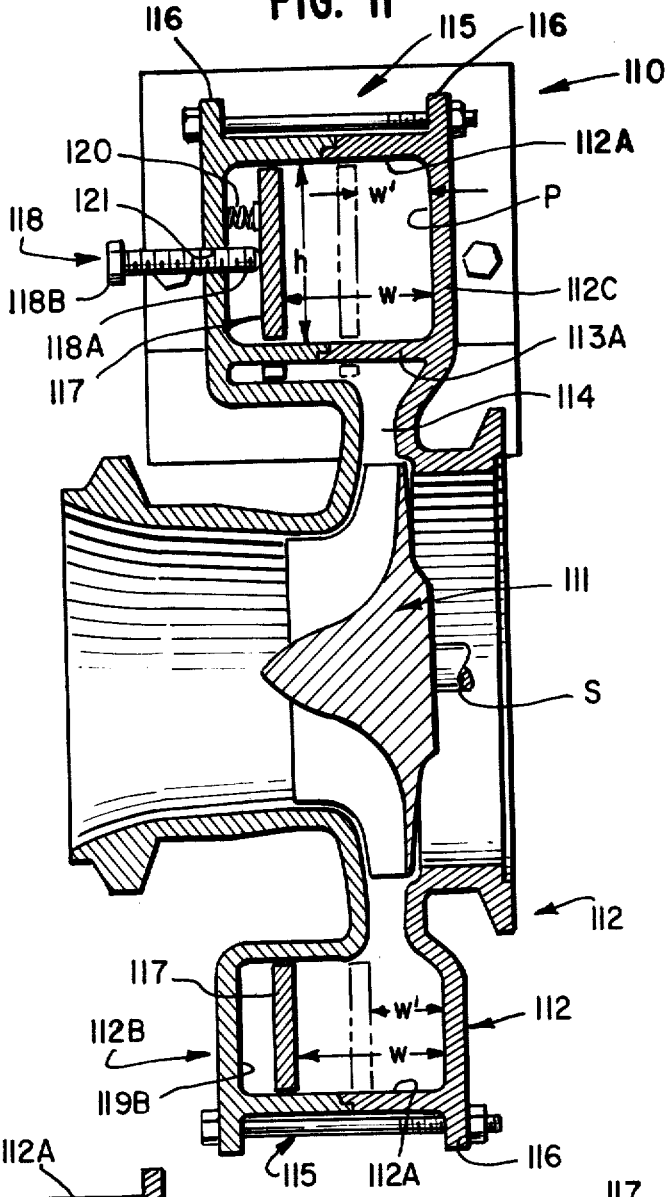
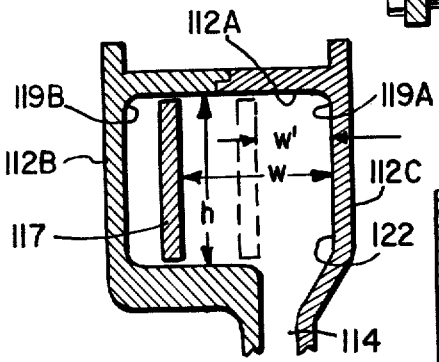
FIG. 12
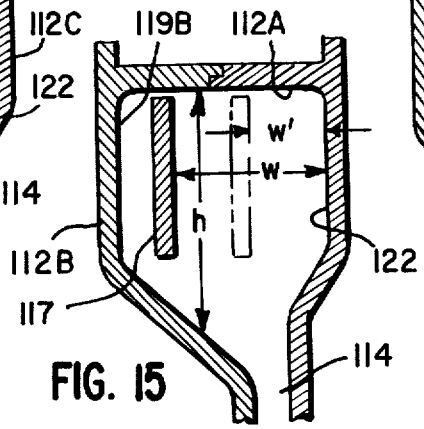
FIG. 15
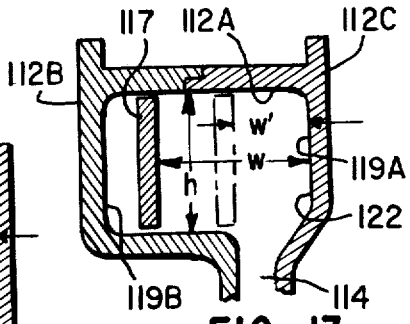
FIG. 13

CASTING FOR A TURBINE WHEEL

This is a continuation of application Ser. No. 953,101 filed Oct. 20, 1978, now abandoned.

BACKGROUND OF THE INVENTION

The efficiency of a turbocharger on a diesel engine has been an important design consideration for many years particularly with the trend towards the diesel engine being subjected to higher torque rise and lower torque peak speeds. A turbine casing is essentially made up of a volute-shaped conical section wrapped around a turbine wheel. Analyses have been based upon the decreasing area or decreasing A/R (area÷radius) around the circumference of the casing. Using these conventional methods, either the cross-sectional area of the volute-shaped passageway or the A/R value at any tangential location decreases uniformly through an angle of 360°. These methods are described in the literature and are well known to those skilled in the art of turbine design.

To meet the efficiency and operating requirements described above, various types of turbine casings of both fixed and variable geometry have heretofore been developed; however, such casings have been beset with one or more of the following shortcomings: (a) the casing was of complex, costly and bulky construction; (b) the vortex of the passageway did not remain centered with respect to the turbine wheel, resulting in non-uniform wheel boarding states and exit states around the periphery of the turbine exducer; (c) the turbine wheel's pressure ratio versus mass flow characteristics were not matched to minimize wheel exit losses; (d) turbine wheel blade vibration was excessive, leading to turbine wheel mechanical failures; and (e) the percentage of change in the width of the passageway did not remain substantially constant throughout the length of the passageway. Additional problems included fluid mixing problems near the housing tongue, and angular momentum losses in the housing and turbine.

SUMMARY OF THE INVENTION

Thus, it is an object of the invention to provide turbine casings of both variable and fixed geometry which readily overcome the aforesaid problems associated with prior casings of these general types.

It is a further object of the invention to provide turbine casings of the type described wherein the fluid flow as it boards the turbine wheel has the characteristics of an irrotational free vortex centered about the turbine wheel axis of rotation.

It is a further object of the invention to provide a turbine casing of the type described which requires a minimual amount of maintenance.

It is a further object of the invention to provide a turbine casing of the type described which has near optimum efficiency and a low aerodynamic blade vibration excitation level.

Further and additional objects will appear from the description, accompanying drawings, and appended claims.

In accordance with one embodiment of the invention a turbine housing surrounds the periphery of a turbine wheel having an axis of rotation. The housing includes at least one substantially spiral fluid passageway having an external inlet and internal outlet for encompassing the turbine wheel periphery. Each of the passageways is defined by a pair of opposed axisymmetrical side walls having inner diameters proximate the periphery of the turbine wheel and an outer wall extending between the side walls. The outer wall extends circumferentially around at least 360 arc degrees of the turbine wheel axis and its location is defined by the path prescribed by the direction of the fluid flow in a free vortex constrained by the side walls. In accordance with another embodiment of the invention, a substantially spiral partition is mounted within the fluid passageway for selective movement transversely of the longitudinal axis of the passageway.

For a more complete understanding of the invention, reference should be made to the drawings wherein.

Figure 1:
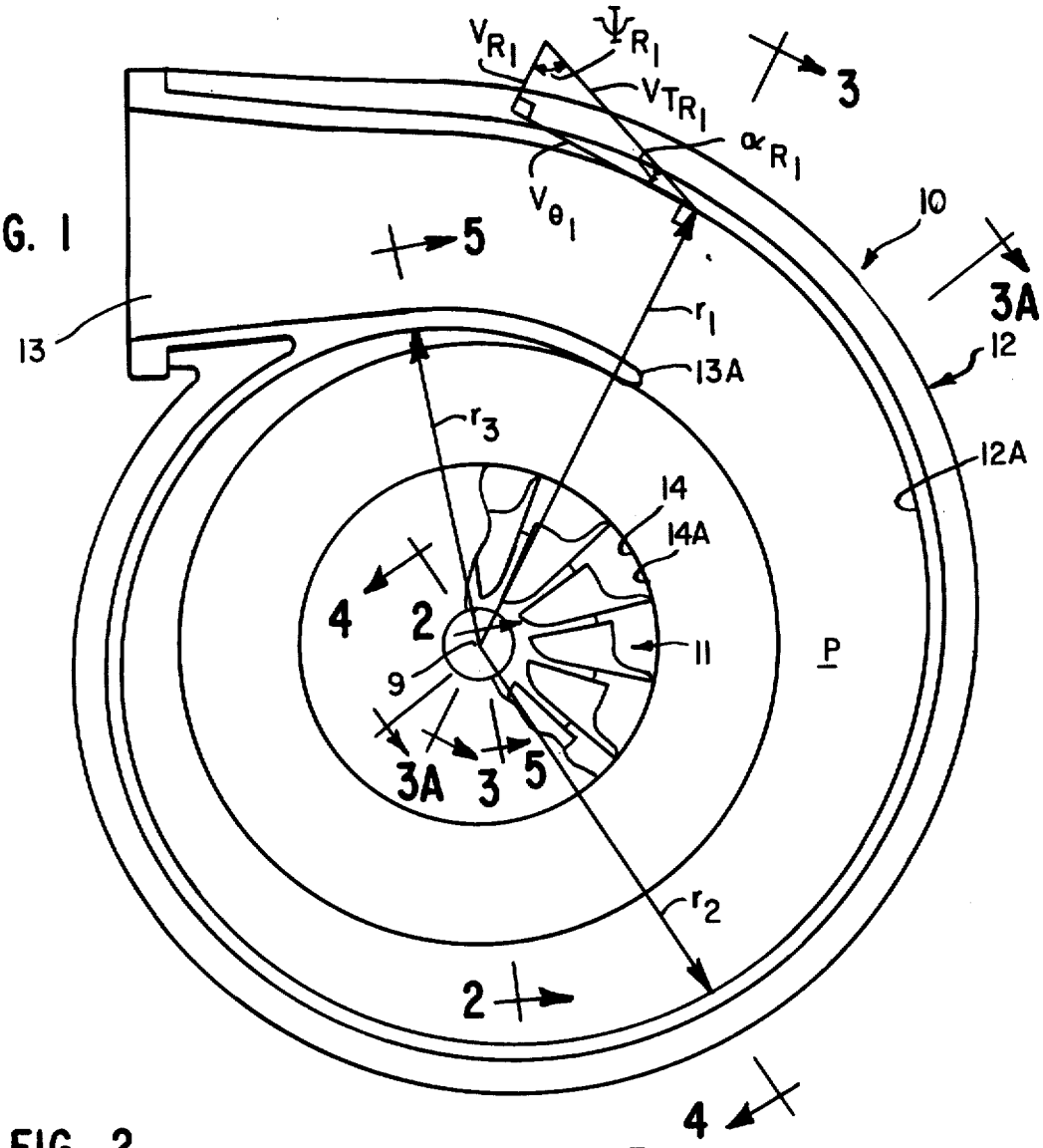
FIG. 1 is a fragmentary sectional view of one form of the improved casing taken along line 10—10 of FIG. 14; said section line being disposed perpendicular to the rotary axis of the turbine wheel.
Figure 3:
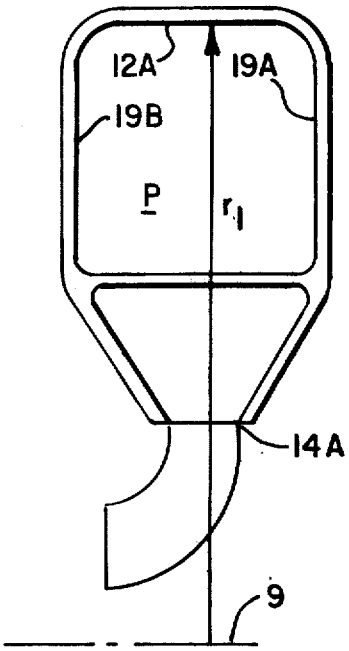
Figure 4:
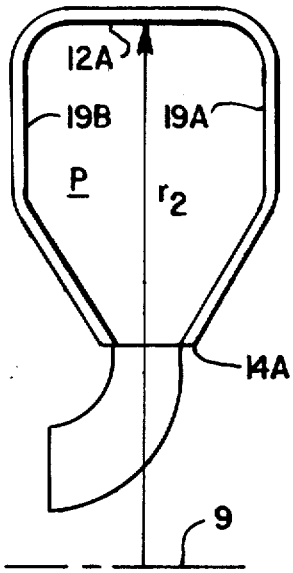
Figure 5:
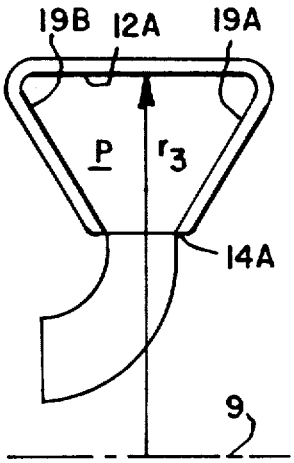

FIGS. 3, 4 and 5 are fragmentary cross-sectional views of one form of the improved casing taken along lines 3—3, 4—4 and 5—5, respectively, of FIG. 1.

FIGS. 6, 7, 8 and 9 are fragmentary cross-sectional views of alternate embodiments of the improved casing. Said views correspond to sections taken along line *3a—3a* of FIG. 1.

FIG. 10 is a fragmentary sectional view of one form of the improved casing taken along line 10—10 of FIG. 14.

FIG. 11 is a fragmentary sectional view taken along line 11—11 of FIG. 10.

FIGS. 12 and 13 are fragmentary sectional views taken along lines 12—12 and 13—13, respectively, of FIG. 10.

FIG. 14 is a fragmentary sectional view taken along line 14—14 of FIG. 10.

FIG. 15 is a fragmentary sectional view of an alternate embodiment of the improved casing; said view corresponds to a section taken along line 13—13 of FIG. 10.

Referring now to the drawings and more particularly to FIG. 1, a turbine 10 is shown in partial section which includes a conventional turbine wheel 11 rotatably mounted about an axis of rotation 9 within an improved centered vortex type of casing 12. It is the casing which embodies the invention in question and not the turbine wheel.

The casing is provided with a generally spiral elongated passageway P through which fluid (e.g., diesel engine exhaust gas) is caused to flow. The passageway is provided with an exterior peripheral fluid inlet 13 and an internal fluid outlet 14, the latter being substantially circular and surrounding the periphery of the turbine wheel 11. The inlet 13 is connected to a fluid source, such as an exhaust manifold, not shown, or conventional diesel engine, by suitable fastening means.

The peripheral wall 12A of the housing 12 becomes a tongue 13A when it extends greater than 360 arc degrees beyond the inlet 13.

Referring also to FIGS. 2–5, the passageway P is defined by a pair of opposed side walls 19A and 19B axisymmetrical with respect to the turbine wheel axis.

The peripheral wall 12A extends between said side walls in a direction generally parallel to the axis of the turbine wheel 11 and extends circumferentially from the inlet 13 around at least 360 arc degrees of said axis. The radial location of said wall 12A with respect to the turbine wheel axis is defined by the path prescribed by the direction of said fluid flow in a free vortex constrained by said side walls.

In designing an improved geometry casing, it is desirable that the turbine wheel be surrounded by a fluid flow which, as it boards the wheel, has the characteristics of an irrotational free vortex centered about the axis of the turbine wheel. Referring to FIGS. 1 through 5, particularly FIG. 2, and if friction is considered negligible for the moment, the equations presented below relate dimensionally to FIG. 2 and represent a description of the assumptions and analysis used to describe the desired free vortex shape about the turbine wheel:

$$V_{ti} = \sqrt{\left(\left(\frac{(P_{ti})}{P_{si}}\right)^{\frac{(\gamma-1)}{\gamma}} - 1\right) \times \frac{2\gamma g c R T_s}{\gamma - 1}} \quad (1)$$

$$V_{ri} = \frac{m\ R\ T_s}{2\ \pi\ r_i b_i\ P_s} \quad (2)$$

$$V_{\theta i} = \sqrt{V_{ti}^2 - V_{ri}^2} \quad (3)$$

$$V_{\theta i} = V_{\theta o} \times \frac{r_o}{r_i} \quad (4)$$

$$\psi_i = \arctan\left(\frac{V_{\theta i}}{V_{ri}}\right) \quad (5)$$

$$\alpha_i = 90^\circ - \psi_i \quad (6)$$

where:

$b_i$ Local casing axial width at any radius, ft. [$b_i = f(r_i)$]
$g_c$ Gravitational constant, lbm-ft/lbf-sec$^2$
$H_d$ Hydraulic diameter, ft.
m Mass flow rate, lbm/min
$P_T$ Total pressure, lbf/ft$^2$
$P_S$ Static pressure, lbf/ft$^2$
R Gas constant, ft-lbf/lbm-°R
$r_o$ Wheel inlet radius, ft.
$r_i$ Radius from center of casing, ft.
$T_S$ Static temperature, °R
$V_T$ Total velocity, ft/sec
$V_r$ Radial component of velocity, ft/sec
$V_{ri}$ Radial component of velocity at radius, $r_i$, ft/sec
$V_\theta$ Tangential component of velocity, ft/sec
$V\theta_i$ Tangential component of velocity at radius, $r_i$, ft/sec
$V_{74\ o}$ Tangential component of velocity at wheel inlet radius, ft/sec
$\gamma$ Ratio of specific heats
$\Psi$ Angle between radius and total velocity components
$\alpha$ Angle between tangential component and total velocity components Equation 1 is a statement that relates the locally existing total velocity to the total-to-static pressure ratio between the local conditions and inlet stagnation and it is a statement of conservation of energy within the system. Equation 2 states the radial velocity as a function of local densities in the areas of interest and is a statement of mass flow continuity. Equation 3 represents a required geometric interrelationship between the existing tangential and radial velocities. Equation 4 presents the relationship that exists between the tangential velocity at any radius within the free vortex to the tangential velocity existing at the wheel boarding radius and is a statement of the conservation of angular momentum within the free vortex about the wheel.

Figure 2:
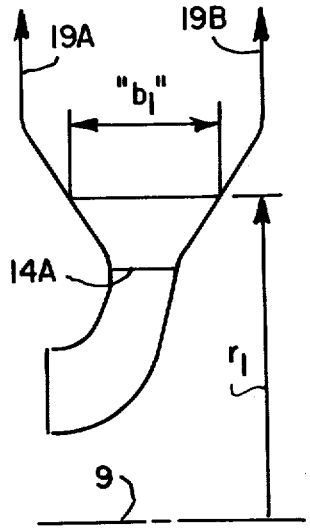
FIG. 2 is a fragmentary cross-sectional view taken along line 2—2 of FIG. 1 illustrating the geometric relationship between $b_i$ and $r_i$.
Figure 2A:
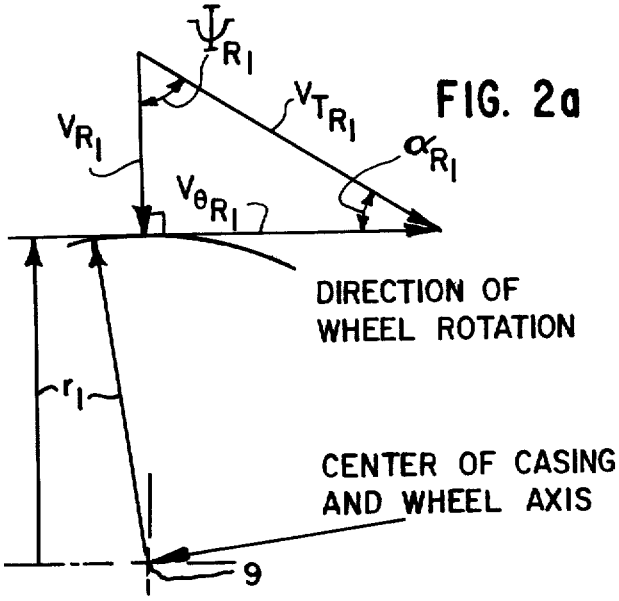
FIG. 2A is a vector diagram illustrating the path described by a fluid flow in a free vortex at radius $r_i$ as constrained by side walls at a width $b_i$.

Referring to FIGS. 1 and 2, in order to start the calculation, it is necessary to determine the desired gas state at the wheel periphery 14A. The design calculations assume the total temperature, total pressure, and the desired tangential velocity, all at the wheel outer radius 14A. When these assumptions are considered along with knowledge of the desired mass flow rate and width of the casing at the wheel outer radius, the desired wheel boarding state is defined. With this information and an arbitrarily specified schedule of casing width $b_i$ with increase in casing radius $r_i$, a series of calculations can be completed to determine the tangential and radial gas velocity components required at any given casing radius.

One of the requirements for this analysis to be appropriate is that the casing side walls 19A and 19B be axisymmetric; that is, the side walls of the casing should be such that they could be lathe cut by rotation around the turbine axis 9. Thus, except for the effects of friction, there would be no resolved wall pressure components which interact with the fluid tangential velocity as the gas moves inward to smaller radii.

The calculation determines the appropriate velocity components at a series of radii $r_i$ away from the turbine wheel axis 9. From this series of calculations a particle path within this vortex flow field can be determined. By appropriate manipulation of the casing width dimension $b_i$, this particle path can be made to travel in a variety of spiral paths with the individual spiral shape being a direct result of the existing schedule in casing width $b_i$ as radius $r_i$ is increased. By experimenting with a variety of casing width schedules versus radius, it is possible to develop a spiral path which, within any desired prechosen outer radius, will make a full revolution about the turbine wheel. In order to construct a turbine casing which contains flow paths that are very similar to these desired free vortex paths, one needs only to insert a casing outer wall 12A which joins the axisymmetrical casing side walls 19A and 19B and travels spirally along a path determined by the desired particle path within the free vortex as constrained by the side walls.

The angle $\Psi$ that outer wall 12A makes to radius $r_i$ from the wheel axis 9, in a plane perpendicular to the wheel axis of rotation, is determined from the fluid flow pattern as follows:

$$\psi = \arctan\left(\frac{V_{oi}}{V_{ri}}\right)$$

Figure 6:
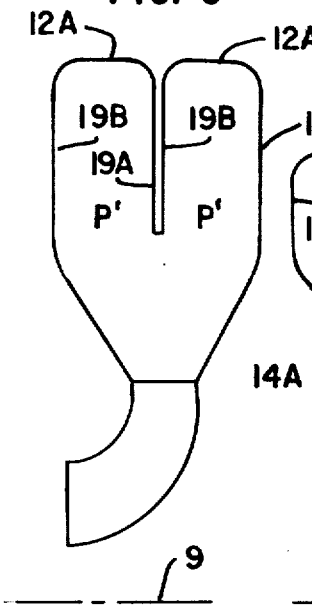
Figure 7:
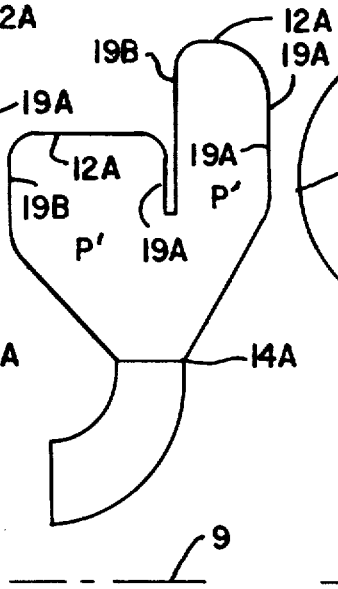
Figure 8:
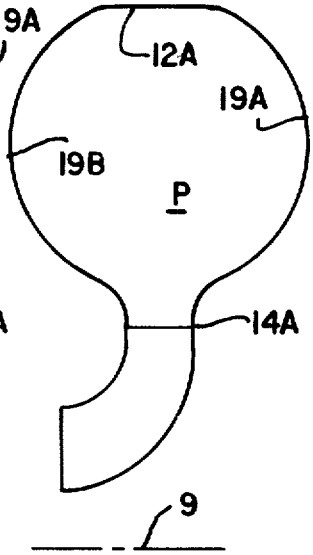
Figure 9:
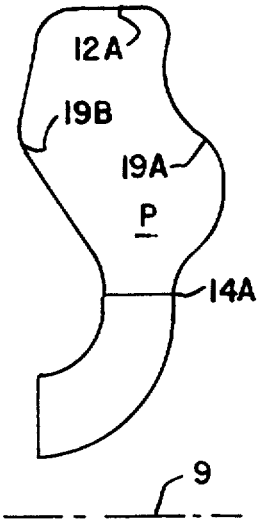

Since in this analysis the schedule of casing width $b_i$ versus radius $r_i$ can be chosen arbitrarily provided the side walls are axisymmetrical, a wide variety of casing shapes can be evolved with whatever overall envelope or configurational constraints might exist for a given design, such as external casing size restraints or fluid mass flow rates. See FIGS. 6–9, which depict single and multiple fluid passageway alternate embodiments. In FIGS. 6 and 7, each subpassageway P′ has axisymmetrical side walls 19A and 19B independent of the other subpassageway. Accordingly, each subpassageway has a peripheral wall 12A independent of the other. Corners may be rounded or eased to facilitate molding, casting, or other manufacturing steps.

While the disclosed equations and the teachings of their utilization allow one skilled in the art to practice the present invention, further refinements may be included as desired. This may include, for instance, compensation for frictional losses, as calculated by an ordinary turbulent pipe friction analysis, which is well described in current literature.

As noted earlier, the desired fluid state for wheel boarding is one of uniform angular momentum distribution. To make the appropriate transition from the fluid's nonuniform original input pipe states to the desired state, the major determinent is believed to be the length and the shape of the bend that occurs in the fluid inlet 13 before the gas is released to continue the proposed free vortex path. Said bend may assume a variety of forms provided they are curved in the same general direction of flow as the passageway P. It is not necessary that said bend be defined by the free vortex equations herein nor be spiral. A bend of between 30 and 120 arc degrees about the wheel axis 9 has provided the optimum turbine efficiencies. Stated otherwise, a tongue that extends 30 to 120 arc degrees into the casing is desirable. Bends of shorter length are believed to reduce the turbine efficiency because of fluid state variations around the wheel periphery caused by the inlet effect. Casings in which the bend is longer suffer a measured degradation in efficiency which is apparently associated with the frictional impact of the added wall surface within the casing 12.

Another improvement is a reduction in the turbine wheel vibrational excitation. Since the degree of variation in wheel boarding states is reduced by the improved casings, the level of the input forces that excite this wheel vibration have been significantly reduced.

While the embodiment described thus far has been restricted to fixed geometry housings, the teachings are equally applicable to variable geometry housings, as depicted in FIGS. 10–15, and described below. Corresponding elements for the variable geometry housing have a 100-series number.

To provide the appropriate wall forces in variable geometry casings, it is necessary to supply a partition 117 which ends at a smaller radius than the turbine casing inlet tongue 113A. The partition 117 has an inner circular radius 117A which is positioned axisymmetrically about the turbine wheel 111. The casing axial width is constant for radii larger than the partition's inner radius. This allows a constant percentage variation in casing width at all radii so as to create an appropriate velocity distribution at all desired mass flows.

As seen in FIG. 11, the casing 112 may be formed of two mating sections 112B, 112C which are retained in assembled relation by a plurality of symmetrically arranged nut and bolt combinations 115 which engage a pair of peripheral flanges 116. One piece castings, welded assemblies, and the like are all acceptable variations.

Disposed within passageway P and extending substantially the entire length thereof is a substantially spiral elongated partition 117. The partition is mounted within the passageway and is adapted to be selectively moved transversely of the passageway; that is to say, in a direction at substantially a right angle to the longitudinal axis of the passageway P. As seen in FIGS. 11 and 14, the partition 117 may be manually or automatically adjusted by a plurality of cap bolts 118, and said bolts may be moved independent of one another. Associated with the bolts are a plurality of coil springs 120 which cause the concealed side of the partition 117 to be in constant contact with the end 118A of each bolt. Suitable internally threaded openings 121 are formed in casing section 112B to receive the threaded shank of the bolt. The cap, or head, 118B of the bolt is exposed and may be turned by a wrench or the like to effect adjustment of the partition.

A variety of other pneumatically or electrically energized means, not shown, may be utilized to effect selective movement of the partition. Such means are well known to those skilled in the art of variable geometry or variable nozzle turbomachines.

The side of the partition opposite that engaged by the bolt end 118A coacts with a stationary wall 122 of the casing section 112C to form the passageway P of desired dimension. While the partition 117 is shown to be manually adjusted, it may, if desired, be automatically adjustable. In the latter case the automatic adjustment may be determined by the desired pressure ratio between the fluid inlet and fluid outlet and the fluid mass flow rates at any given time, as well as other indicators of turbine or engine operation, such as temperature, revolutions per minute, load, etc.

FIGS. 11–13 and 15 show the partition 117, in full lines, in one relative position with respect to wall 122 wherein the width of the passageway P is w for a given mass fluid flow. Where, however, the fluid mass flow rate is to be substantially less, the partition 117 is adjusted towards wall 122 and the width w' of the passageway is reduced, for instance, approximately one half the width w, or any other fraction thereof.

As noted in FIGS. 10 and 14, the end 123 of partition 117 adjacent the fluid inlet 113 is offset transversely and pivotally connected to partition 117 so as to form a baffle. Said baffle remains in contact with a side wall regardless of the position of the partition in the passageway. The baffle is to prevent the entering fluid from becoming entrapped between the partition 117 and the passageway wall 125. While the inlet end 123 of the partition is shown offset transversely in order to form a baffle, other means of blocking entry of the fluid behind the partition may be utilized though not shown. Thus, it is to be understood that the invention is not intended to be limited to the baffle construction shown in FIG. 14.

It will be noted that there is sufficient clearance between the periphery of partition 117 and the adjacent surfaces of the casing to permit the partition to be readily adjusted without interference. It should also be noted that when the partition is moved transversely of the walls 122 and 125, the partition changes the cross-sectional area of the passageway P, thus resulting in a more desirable pressure ratio between the inlet 113 and outlet 114 being maintained.

The variable geometry housing disclosed thus far is known as a closed wall casing wherein the partition 117 forms a generally fluid tight seal against the housing or passageway side and peripheral walls. The baffle is optional and may be omitted if said seal is generally fluid tight, thereby forming a generally spiral shaped dead air space open on only one end and allowing passage of only inconsequential leakage flows. An alternate embodiment is the open wall casing of FIG. 15 wherein only one edge of the partition forms a generally fluid tight seal against the housing or passageway peripheral wall 112A, and the other edge is free standing. However, an inlet baffle is required in order for the open wall moveable housing to function as desired.

Further variations may include a partition comprised of multiple moveable partitions adjacent one another which may be independently adjusted as desired. While such an embodiment may not have axisymmetrical side walls, it is certainly a viable alternative thereto and provides additional flexibility in turbine casing geometry.

As will be noted in FIGS. 11–13 and 15, with a moveable wall centered vortex casing, the height h of the passageway, which is linearly related to $r_i$, is reduced in accordance with the equations set forth herein, as one approaches the outlet 114.

In a typical fixed geometry casing, a change in fluid mass flow rate will cause a change in overall turbine pressure ratio at constant wheel speed. With the improved variable geometry casing the width w of the passageway is changed to compensate for the change in fluid mass flow rate and thus, the pressure ratio could remain substantially unchanged. Alternatively, the width w may be changed to maintain a relatively constant mass flow rate when there is a change in the pressure ratio. Still further, a change in the passageway may result in a change in both variables. The turbine wheel 111, as aforementioned, may be of conventional design and have a shaft S (FIG. 11) extending axially from one side of the wheel to a compressor wheel, not shown.

Thus, an improved casing is provided with a variable geometry capability so as to maintain a more desirable relationship between fluid mass flow rates and overall turbine pressure ratios. Further, the casing is of simple, compact construction requiring only a minimal amount of maintenance. The improved casing may be utilized in a wide variety of turbines, such as radial, axial, or mixed flow turbine configurations. This invention allows one to distribute turbine casing areas yet provide the optimum turbine casing geometry for a given set of design constraints, such as overall size, while still maintaining a basically uniform turbine inlet state. This improved uniformity in turbine inlet state results in significantly improved turbine efficiencies.

While particular embodiments of the invention have been shown, it will be understood, of course, that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and the scope of the invention.

What is claimed is:

1. A nozzleless centered vortex fixed geometry turbine housing surrounding the periphery of a turbine wheel having an axis of rotation, said housing including at least one elongated substantially spiral compressible fluid passageway having an external inlet and an internal outlet for encompassing said wheel periphery, the said passageway being defined by a pair of opposed axisymmetrical side walls extending circumferentially around at least 360 arc degrees of said axis and having inner diameters proximate the periphery of said turbine wheel, said axisymmetry resulting in a predetermined constant distance between said opposing side walls at a given radius from said turbine wheel axis, said distance measured parallel to said turbine wheel axis and varying only as a function of radial distance and not as a function of arc degrees, and a peripheral wall extending between said side walls in a direction parallel to the axis of said turbine wheel, said peripheral wall coextensive with said axisymmetrical side walls around at least 360 arc degrees of said axis, the radial distance of said peripheral wall from said turbine wheel axis being defined by the path prescribed by the direction of said fluid flow in a free vortex concentric with said turbine wheel axis and constrained by said axisymmetrical side walls, the angle between a tangent to said peripheral wall at a given location and a radial line from the wheel axis to said location, measured in a plane perpendicular to the wheel axis of rotation, varying as a function of the radial and tangential components of the fluid velocity at that location, whereby there are no resolved wall pressure components, except for the effects of friction, which interact with the fluid tangential velocity as said fluid moves inwards from said inlet to said outlet.

2. The casing of claim 1 wherein said passageway extends more than 360 arc degrees beyond said inlet to form said inlet overlapping said passageway.

3. The casing of claim 2 wherein said overlap portion extends from about 30 to about 120 arc degrees with respect to said axis.

4. The casing of claim 1 wherein said passageway comprises a plurality of subpassageways to form a divided casing.

5. The casing of claim 4 wherein each of said subpassageways has axisymmetrical side walls independent of the side walls of any other of said subpassageways at the same radius.

6. The casing of claim 1 wherein said internal outlet is formed by said side wall inner diameters proximate the periphery of said wheel.

7. The casing of claim 1 wherein said internal outlet is substantially circular.

8. The casing of claim 1 wherein said passageway cross-sectional area generally decreases from said inlet to said outlet.

9. The casing of claim 1 wherein said angle at a given location is the arctangent of the quotient of the tangential and radial components of the fluid velocity at a given radius.

* * * * *